US005437413A

United States Patent [19]

Shen et al.

[11] Patent Number: 5,437,413

[45] Date of Patent: Aug. 1, 1995

[54] MULTIPLE DISK AIR ASSIST ATOMIZER FOR FUEL INJECTION

[75] Inventors: Jingming J. Shen, Newport New; Vernon R. Warner, Wicomico, both of Va.

[73] Assignee: Siemens Automotive L.P., Auburn Hills, Mich.

[21] Appl. No.: 217,589

[22] Filed: Mar. 24, 1994

[51] Int. Cl.[6] ..... F02M 61/00

[52] U.S. Cl. ..... 239/424.5; 239/431; 239/533.12; 239/585.4; 239/596

[58] Field of Search ..... 239/585.1–585.3, 239/533.12, 601, 429–431, 555, 424, 424.5, 417.3, 596

[56] References Cited

U.S. PATENT DOCUMENTS

| | | | |
|---|---|---|---|
| 1,118,753 | 11/1914 | Evers | 239/431 |
| 4,018,387 | 4/1977 | Erb et al. | 239/424 X |
| 4,625,916 | 12/1986 | Niewkamp et al. | 239/431 |
| 4,923,169 | 5/1990 | Grieb et al. | 239/585.1 |
| 5,174,505 | 12/1992 | Shen | 239/585.1 X |
| 5,211,341 | 5/1993 | Wieczorek | 239/585.3 |
| 5,323,966 | 6/1994 | Buchholz et al. | 239/585.5 X |

FOREIGN PATENT DOCUMENTS

| | | | |
|---|---|---|---|
| 3943096 | 7/1990 | Germany | 239/431 |

*Primary Examiner*—Andres Kashnikow
*Assistant Examiner*—Kevin Weldon
*Attorney, Agent, or Firm*—Russel C. Wells

[57] ABSTRACT

The atomizer is a cap-shaped shroud that contains a stack of flat stamped metal inserts. When assembled onto the nozzle of a fuel injector, the atomizer causes the inserts to be axially sandwiched between the shroud's end wall and the exterior end of the nozzle. In the zone of sandwiching, the inserts have circumferential discontinuities that in cooperation with the nozzle end and the shroud's end wall define air assist openings for the assist air to flow radially inwardly toward the injected fuel that has just been injected from the nozzle. An air assist opening in one insert is thereby both circumferentially and axially offset from an air assist opening in another insert.

10 Claims, 4 Drawing Sheets

MULTIPLE DISK AIR ASSIST ATOMIZER FOR FUEL INJECTION

FIELD OF THE INVENTION

This invention relates generally to fuel injectors of the type that are used to inject liquid fuel into the air induction system of an internal combustion engine and particularly to an atomizer that fits over the nozzle of such a fuel injector and serves to convey assist air to promote the atomization of the injected liquid fuel that has just left the nozzle.

BACKGROUND AND SUMMARY OF THE INVENTION

Air assist atomization of the liquid fuel injected from the nozzle of a fuel injector is a known technique that is used to promote better preparation of the combustible air/fuel mixture that is introduced into the combustion chambers of an internal combustion engine. A better mixture preparation promotes both a cleaner and a more efficient combustion process, a desirable goal from the standpoint of both exhaust emissions and fuel economy.

The state of the art contains a substantial number of patents relating to air assist atomization technology. The technology recognizes the benefits that can be gained by the inclusion of special assist air passages that direct the assist air into interaction with the injected liquid fuel. Certain air assist fuel injection systems use pressurized air, from either a pump or some other source of pressurization, as the assist air. Other systems rely on the pressure differential that exists between the atmosphere and the engine's induction system during certain conditions of engine operation. It is a common technique to mount the fuel injectors in an engine manifold or fuel rail which is constructed to include assist air passages for delivering the assist air to the individual injectors.

The state of the art that is presumptively known to the Applicants is represented by the file of commonly assigned U.S. Pat. No. 5,174,505 (J. J. Shen, 29 Dec. 1992) which relates to a disk-type atomizer containing a single disk within a shroud that is fitted over the nozzle end of the fuel injector. While the present invention utilizes the same type of disk as disclosed in U.S. Pat. No. 5,174,505, and also possesses the advantages of that patented fuel atomizer, the present invention is distinguished by the use of a stack of plural disks in which the air assist openings of one disk are circumferentially offset from those of another disk whereby assist air is directed radially inwardly at locations that are both axially and circumferentially offset from each other. The objective of the present invention is toward still further improvement in fuel atomization by the action of the assist air streams on the injected fuel causing further fuel shearing that further reduces fuel particle size.

Further features, advantages, and benefits of the present invention will be seen in the ensuing description and claims which are accompanied by drawings. These drawings disclose a presently preferred embodiment of the invention according to the best mode contemplated at this time for carrying out the invention.

DESCRIPTION OF THE PREFERRED EMBODIMENT

Figure 1:
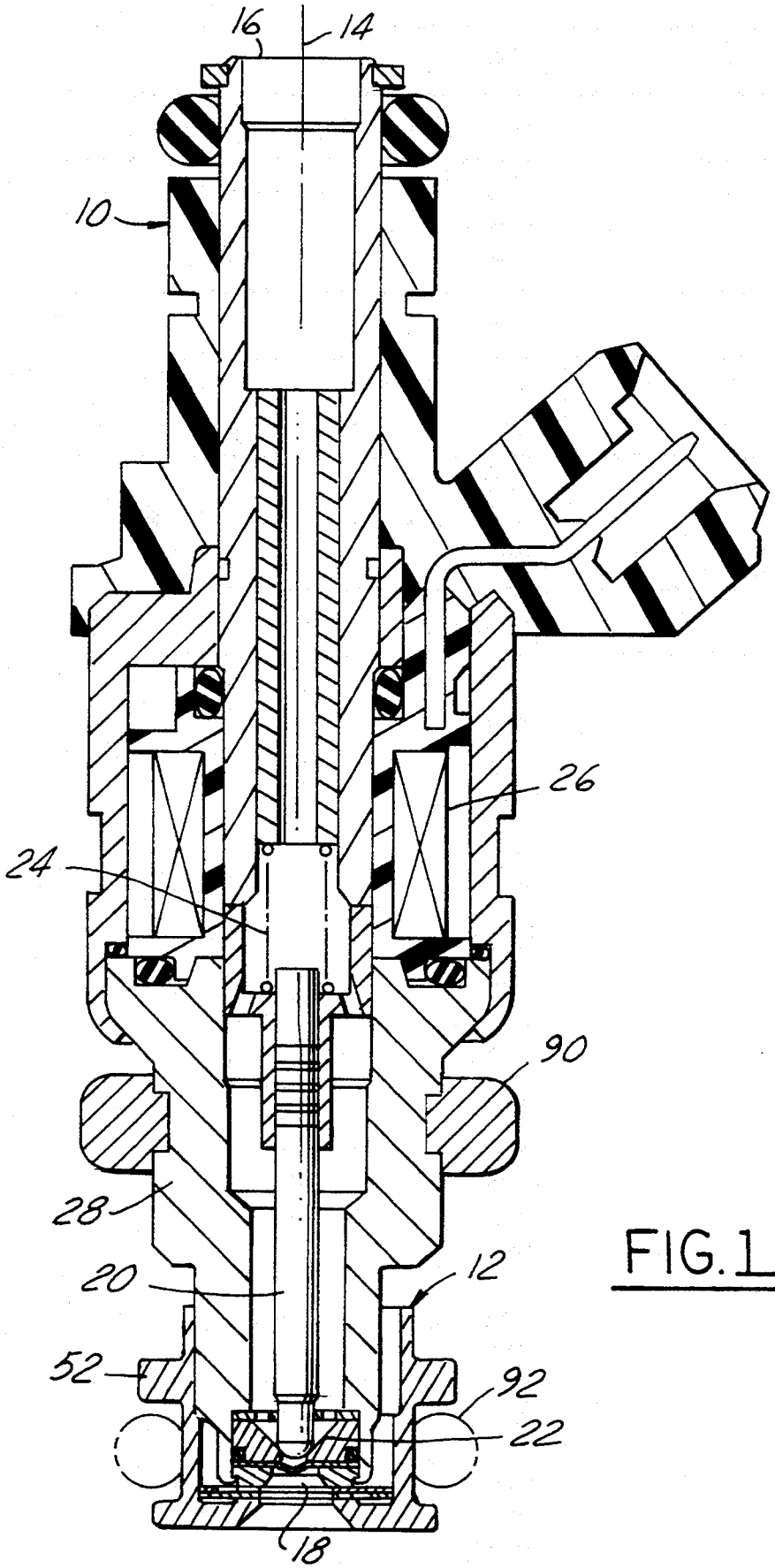
FIG. 1 is a longitudinal cross sectional view through a fuel injector containing an air assist atomizer in accordance with principles of the present invention.
Figure 2:
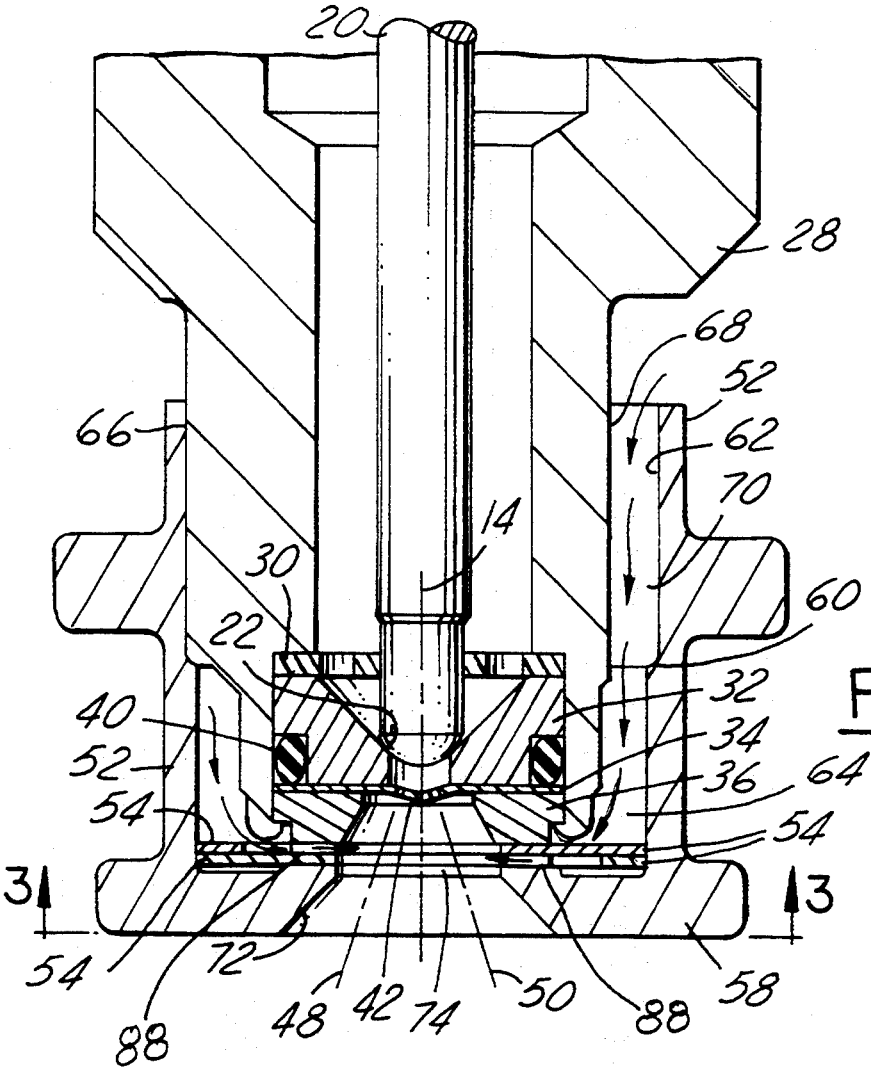
FIG. 2 is an enlarged view of the nozzle end of the fuel injector of FIG. 1.
Figure 3:
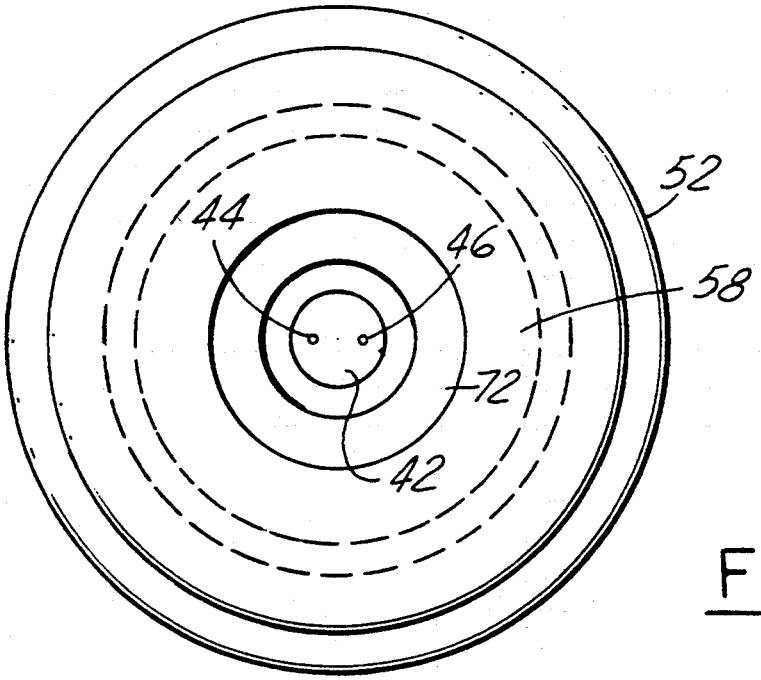
FIG. 3 is a full end view in the direction of arrows 3—3 in FIG. 2.
Figure 5:
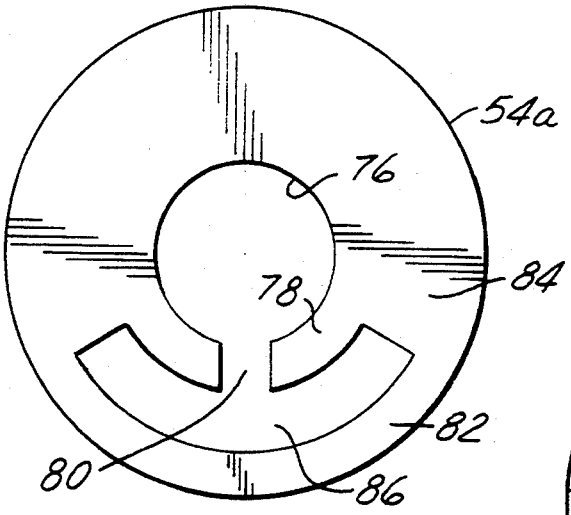
FIG. 5 is a plan view of the disk of FIG. 4.

FIGS. 1–3 illustrate an electrically operated fuel injector 10 containing an air assist atomizer 12 embodying principles of the invention. Fuel injector 10 has a main longitudinal axis 14 and is a top-feed type device comprising an inlet 16 and a nozzle 18 at its opposite axial ends. The passage of liquid fuel through the fuel injector between inlet 16 and nozzle 18 is controlled by the seating and unseating of the rounded tip end of a metal needle 20 on and from a valve seat 22 located just interior of nozzle 18. Needle 20 is resiliently biased by a spring 24 to seat on seat 22 thereby closing the passage to flow. When the valve is electrically energized by the delivery of electric energizing current to its solenoid coil 26, the needle unseats to allow fuel flow. FIGS. 1 and 2 show the fuel injector closed.

The construction in the vicinity of nozzle 18 is shown in greater detail in FIG. 2. The fuel injector comprises a generally tubular metal housing 28 which contains in order of assembly at the nozzle end, a metal needle guide member 30, a metal valve seat member 32, a thin disk orifice member 34 made of metal, and a metal retainer member 36. An O-ring seal 40 is disposed between member 32 and the inside wall of housing 28. Thin disk orifice member 34 contains a central conical dimple 42 having exactly two orifices 44, 46 diametrically opposite each other equidistant from axis 14. When the fuel injector is operated open, the pressurized fuel that is supplied to the injector via inlet 16 is injected from nozzle 18 in two distinctly divergent directions represented generally by the respective numerals 48, 50 in FIG. 2. The construction of the injector and its nozzle end which has thus far been described is generally like that disclosed in certain commonly assigned issued patents, and therefore will not be described further at this time so that attention can be focused on the inventive features residing in air assist atomizer 12 and its association with fuel injector 10.

The air assist atomizer comprises three parts in assembly relation with the fuel injector: one part being a shroud 52 and the other two being inserts 54. Shroud 52 possesses a general cap shape having a side wall 56 and an end wall 58. Side wall 56 has a circular cylindrical inside diameter including a shoulder 60 that divides it into a larger diameter portion 62 and a smaller diameter portion 64. Portion 64 extends from immediate contiguousness with end wall 58 to shoulder 60 while portion 62 extends from shoulder 60 to the end of shroud 52 that is opposite end wall 58.

A portion of housing 28 has a nominally circular outside diameter 66 that is dimensioned to allow portion 62 of shroud 52 to snugly fit onto it. However, that nominally circular outside diameter 66 is provided with one or more interruptions, such as an axial flat or slot 68, so as to thereby cooperatively define with the shroud's side wall the entrance portion of axially extending passage means 70 for assist air to flow axially along the outside of housing 28 toward nozzle 18. The small arrows in FIG. 2 represent the assist air flow.

End wall 58 extends radially inwardly from side wall 56 to provide an axially frusto-conically expanding aperture 72 which is coaxial with axis 14 and through which fuel that has just been injected from nozzle 18 passes. A raised circular annular ledge 74 is fashioned on the inside of end wall 58 in circumscription of aperture 72. Inserts 54 form a stack that is disposed axially between nozzle 18 and end wall 58 and is in fact held between ledge 74 and the exterior axial end face of member 36.

Figure 4:
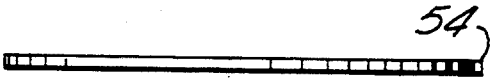
FIG. 4 is a side view in the radial direction of a disk that is used in the air assist atomizer.
Figure 6:
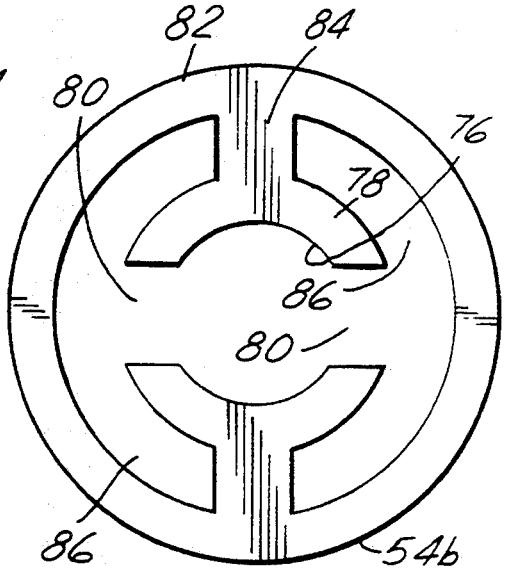
FIG. 6 is a plan view of a second embodiment of disk.
Figure 7:
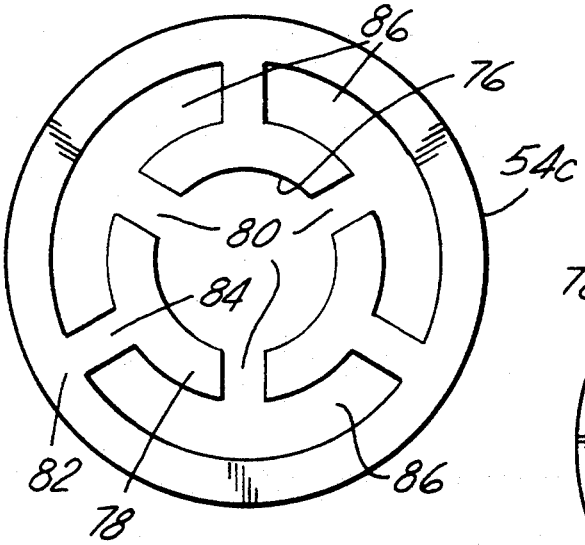
FIG. 7 is a plan view of a third embodiment of disk.
Figure 8:
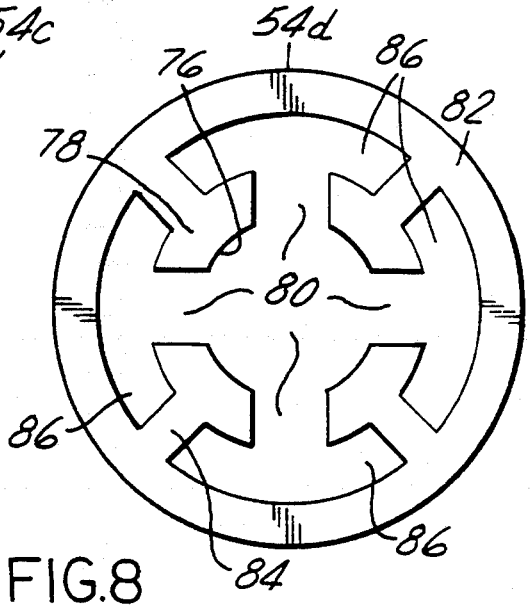
FIG. 8 is a plan view of a fourth embodiment of disk.

FIGS. 5–8 disclose four different embodiments of insert 54, and for convenience each of them is uniquely identified by including a particular literal suffix after the base numeral 54 such that the respective disks are 54*a*, 54*b*, 54*c*, and 54*d* for each of FIGS. 5–8 respectively. The view of FIG. 4 is equally applicable to all four embodiments and is designated by only the base numeral 54.

Each insert 54 is in the form of a disk that is flat and of uniform thickness throughout. It comprises a central circular void 76 that is surrounded by a circular annulus 78 which contains at least one circumferential discontinuity 80. Annulus 78 is bounded in radially outwardly spaced relationship by a second circular annulus 82 which, as shown, is preferably circumferentially continuous. A third circular annulus 84 joins annuli 78 and 82 and comprises one or more circumferential discontinuities 86, each of which is contiguous with a corresponding discontinuity 80 of annulus 78 and has a circumferential extent greater than that of the corresponding discontinuity 80. Void 76, discontinuity 80, and discontinuities 86 are in the nature of through-holes in the disk.

Insert 54*a* has a single discontinuity 80 and a single discontinuity 86; insert 54*b* has two and two; insert 54*c* has three and three; and insert 54*d* has four and four. Each discontinuity 80 is circumferentially centered with respect to its contiguous discontinuity 86, and in the case of inserts 54*b*, 54*c*, and 54*d*, the discontinuities 80 are of equal circumferential dimensions and are arranged in a uniform pattern such that each discontinuity 80 is equally circumferentially spaced from immediately adjacent ones.

The outside diameter (O.D.) of an insert 54 is dimensioned just slightly less than the inside diameter (I.D.) of side wall portion 64 to allow the insert to pass axially through the shroud preparatory to assembling the atomizer to the fuel injector. In this way, annulus 82 functions as a locator to properly center, i.e. radially locate, the insert within the shroud. Such placement serves to dispose annulus 78 of the lower insert 54 on ledge 74 and annulus 78 of the upper insert congruent with that of the lower insert 54 so that when the two-insert-containing shroud is thereafter assembled onto the nozzle by advancing the shroud over the end of housing 28, the two-insert-stack will be sandwiched between and in mutual abutment with ledge 74 and the annular end surface of member 36, as appears in FIGS. 1 and 2.

Figure 9:
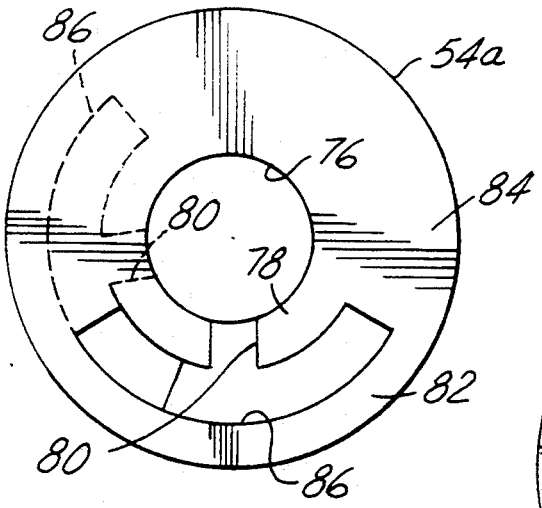
FIG. 9 is a plan view of a representative disk stack using two of the disks of FIG. 5.
Figure 10:
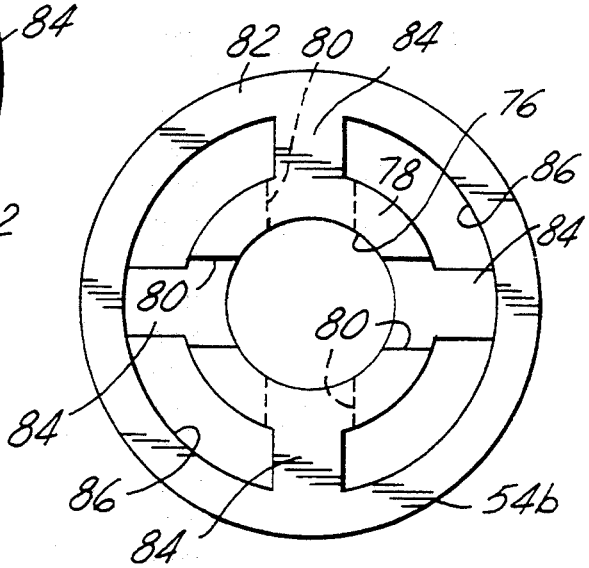
FIG. 10 is a plan view of a representative disk stack using two of the disks of FIG. 6.
Figure 11:
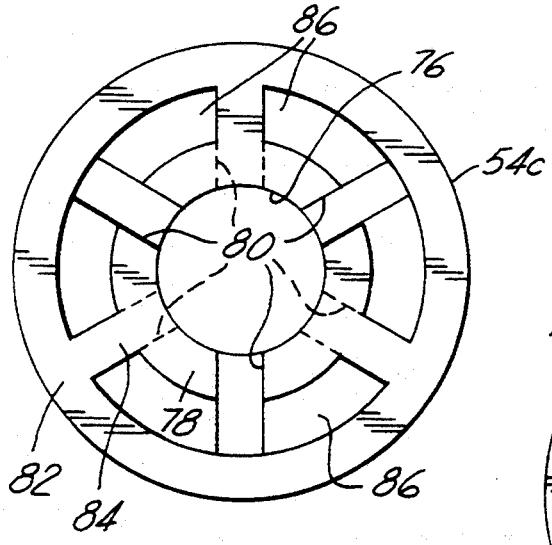
FIG. 11 is a plan view of a representative disk stack using two of the disks of FIG. 7.
Figure 12:
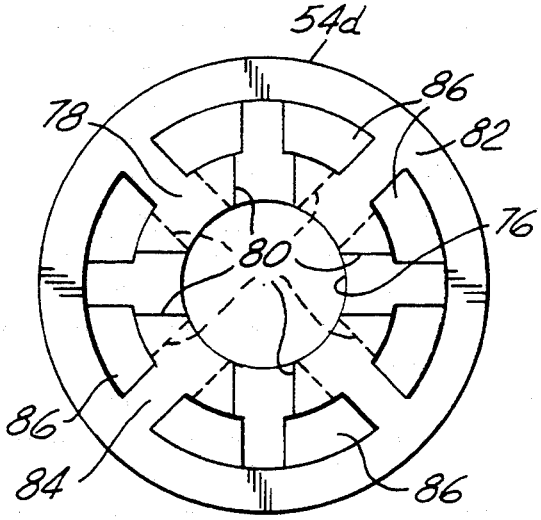
FIG. 12 is a plan view of a representative disk stack using two of the disks of FIG. 8.

Thus after assembly of the atomizer to the fuel injector, the sandwiched stack of inserts 54 will in cooperation with the end surface of member 36 and ledge 74 define a number of air assist openings 88 (see FIG. 2) through which assist air passes radially inwardly toward fuel just injected from the nozzle. The axial dimension of each opening 88 is equal to the thickness of insert 54, and its circumferential extent is equal to the circumferential dimension of the corresponding discontinuity 80 in the insert. Assist air enters each opening 88 from the corresponding discontinuity 86 which is in communication with the inner downstream end of passage means 70. For illustrative purposes, FIG. 2 shows the opening 88 in the upper insert directing assist air from the left (as viewed in the Fig.) and the opening 88 in the lower insert directing assist air from the right. The actual number of openings 88 and their locations will of course depend on the particular insert, or inserts, 54 that is (are) used. In order to assure that assist air can reach a discontinuity 86 in the lower insert 54, at least a portion of a discontinuity 86 in the upper insert 54 must circumferentially overlap it, and that is why in FIG. 9 the two discontinuities 80 cannot be diametrically opposite each other a full 180°.

The illustrated inserts 54 are advantageous in that they can be fabricated by stamping from sheet material. Because they are flat and of uniform thickness throughout, the inserts have an overall axial dimension that is equal to their thickness. While the illustrated inserts do not have express provision for securing circumferential registry with the corresponding shroud, an express means therefor could be incorporated if desired. Likewise, it is possible to secure proper circumferential registry without an express means therefor. In such case, the insert is properly circumferentially oriented on the shroud prior to assembling the shroud over the end of the nozzle. Such circumferential registry is important in the case of a fuel injector which has a thin disk orifice member like that illustrated in FIGS. 1 and 2. This is because it is deemed preferable to align diametrically opposite openings 88 on the common diameter between orifices 44 and 46.

The insert and shroud are fabricated from suitable materials, such as stainless steels. It is preferred that the corners between void 76 and discontinuities 80 be kept sharp while those between discontinuities 80 and 86 be radiused. The several parts of the fuel injector are fabricated from conventional pads and materials in known manner.

The atomizer-equipped fuel injector 10 is adapted to be installed in manifold (not shown) that delivers assist air to the open upstream end of passage means 70. Axially spaced apart O-rings 90, 92 on the outside of housing 28 and the outside of shroud 52 provide for sealing of the atomizer-equipped fuel injector to a socket in the manifold for receiving the injector.

What is claimed is:

1. An air-assisted fuel injector having a nozzle for injecting fuel into an induction air system of an internal combustion engine, and an air assist means fitted onto the nozzle for directing assist air to flow axially along the outside of the nozzle and then radially inwardly toward injected fuel that has just left the nozzle to assist in atomizing the same, the injector comprising a shroud member disposed over the nozzle, having a side wall cooperating with the nozzle to form axially extending passage means via which assist air passes axially along the outside of the nozzle, and an end wall extending radially inwardly from said side wall to form an aperture means through which the injected fuel that has just left the nozzle passes;

an insert member means disposed between said shroud member and the nozzle;

said insert member means having a stack of disks sandwiched axially between and in mutual abutment with both said end wall and the nozzle, in that plural ones of said disks each has a first annulus containing at least one circumferential discontinuity that provides the stack with a corresponding at least one air assist opening through which radially inward flow of assist air passes toward the injected fuel that has just left the nozzle; and said plural ones of said disks are arranged in the stack such that said at least one circumferential discontinuity in a first of said plural ones of said disks is circumferentially offset from said at least one circumferential discontinuity of a second of said plural ones of said disks to cause the corresponding at least one air assist opening of said first of said plural ones of said disks to direct its assist air radially inwardly at a location that is both axially and circumferentially different from the location at which said second of said plural ones of said disks directs its assist air radially inwardly.

2. An air-assisted fuel injector as set forth in claim 1 in which each said first annulus is circular in shape.

3. An air-assisted fuel injector as set forth in claim 1 in which the entirety of each of said first and second of said plural ones of said disks is flat and planar throughout.

4. An air-assisted fuel injector as set forth in claim 1 in which each of said first and second of said plural ones of said disks includes a corresponding locating means disposed radially of its annulus and coacting with said shroud for radially locating its annulus.

5. An air-assisted fuel injector as set forth in claim 4 wherein said locating means further includes a second annulus that is disposed radially outwardly of its first annulus and that coacts with said side wall of said shroud for radially locating said first annulus, and each of said first and second of said plural ones of said disks further includes a corresponding through-hole between its said second annulus and its said first annulus via which assist air passes to its said at least one air assist opening, each said through-hole having a greater circumferential extent than the corresponding at least one air assist opening.

6. An air-assisted fuel injector as set forth in claim 5 in which each said second annulus is circumferentially continuous.

7. An air-assisted fuel injector as set forth in claim 6 in which each of said second annulus and each said first annulus are both circular in shape and are disposed in a common plane in each of said first and second of said plural ones of said disks.

8. An air-assisted fuel injector as set forth in claim 7 in which the entirety of each of said first and second of said plural ones of said disks is flat and planar throughout.

9. An air-assisted fuel injector as set forth in claim 8 in which each said first annulus comprises plural such air assist openings arranged in a circumferentially uniform pattern wherein each such air assist opening is spaced circumferentially substantially equidistant from immediately adjacent ones.

10. An air-assisted fuel injector as set forth in claim 1 in which each said annulus comprises plural such air assist openings arranged in a circumferentially uniform pattern wherein each such air assist opening is spaced circumferentially substantially equidistant from immediately adjacent ones.

* * * * *